US012515765B2

(12) United States Patent
Horan et al.

(10) Patent No.: US 12,515,765 B2
(45) Date of Patent: Jan. 6, 2026

(54) BOARDING SYSTEM AND METHOD

(71) Applicant: CASHMAN DREDGING AND MARINE CONTRACTING, CO., LLC, Quincy, MA (US)

(72) Inventors: Aiden Horan, Waltham, MA (US); Jay Cashman, Quincy, MA (US); Norman Bourque, Rochester, MA (US); Dale Pyatt, Quincy, MA (US); Corey Welch, Lake George, NY (US); Nathaniel Tipton, Brooklyn, NY (US)

(73) Assignee: CASHMAN DREDGING AND MARINE CONTRACTING, CO., LLC, Quincy, MA (US)

( * ) Notice: Subject to any disclaimer, the term of this patent is extended or adjusted under 35 U.S.C. 154(b) by 644 days.

(21) Appl. No.: 17/952,868

(22) Filed: Sep. 26, 2022

(65) Prior Publication Data

US 2023/0098754 A1 Mar. 30, 2023

Related U.S. Application Data

(60) Provisional application No. 63/247,890, filed on Sep. 24, 2021.

(51) Int. Cl.
*B63B 27/14* (2006.01)

(52) U.S. Cl.
CPC ..... *B63B 27/14* (2013.01)

(58) Field of Classification Search
CPC ..... B63B 27/14; B65G 69/28
See application file for complete search history.

(56) References Cited

U.S. PATENT DOCUMENTS

| | | | | |
|---|---|---|---|---|
| 4,133,067 | A * | 1/1979 | Bennett | E01D 15/24 14/71.3 |
| 4,335,803 | A | 6/1982 | Sugita | |
| 8,894,342 | B1 * | 11/2014 | Masciana | E01D 15/24 414/139.5 |
| 2013/0239341 | A1 | 9/2013 | Bruckner et al. | |
| 2015/0344110 | A1 | 12/2015 | van der Tempel et al. | |

FOREIGN PATENT DOCUMENTS

| | | | |
|---|---|---|---|
| CN | 205418010 | U | 8/2016 |
| JP | 2006240381 | A | 9/2006 |

OTHER PUBLICATIONS

Written Opinion of the International Searching Authority dated Jan. 3, 2023.

* cited by examiner

*Primary Examiner* — Anthony D Wiest
(74) *Attorney, Agent, or Firm* — Jacob M. Ward; Ward Law Office LLC

(57) ABSTRACT

A boarding system for passage from one vessel to an adjacent vessel comprises a platform, a plurality of support columns secured to the platform, a stairway attached to the platform, and a gangway pivotally connected to the platform and configured to pivot between a storage position and a deployed position. When the gangway is in the storage position, the gangway is in an upward position and when the gangway is in the deployed position, a distal portion of the gangway engages with the adjacent vessel at an angle corresponding to a condition of the adjacent vessel.

13 Claims, 6 Drawing Sheets

BOARDING SYSTEM AND METHOD

CROSS-REFERENCE TO RELATED APPLICATIONS

This application claims the benefit of U.S. Provisional Application No. 63/247,890, filed on Sep. 24, 2021. The entire disclosure of the above application is incorporated herein by reference.

FIELD

The present disclosure relates to dredging systems, and more particularly to a scow boarding system.

Introduction

This section provides background information related to the present disclosure which is not necessarily prior art.

There are two primary types of dredging currently in use: mechanical dredging and hydraulic dredging. Mechanical dredging involves the use of an excavator or other heavy equipment situated on a floating barge to dig out the bed of a body of water and remove sediment. The sediment is placed in a dump scow, for example a split hull dump scow, and hauled away for disposal or reuse. Hydraulic dredging involves the use of suction to remove the sediment, which is transported through a pipe and deposited to another location to be disposed of or recycled.

Crew members are routinely required to transfer or move from a dredge to the dump scow or other adjacent vessel. This is traditionally accomplished by using a hinged ladder having one end attached to the deck of the dredge, which is swung into position to make contact with the adjacent dump scow, thereby creating a route for passage. Alternatively, the crew members can board an adjacent scow via climbing pigeonholes or footsteps cut into the hull of the scow. However, moving from the dredge to the dump scow can be quite challenging due to the air draft range (distance from a vessel's highest point to its waterline) dump scows experience when going from an empty load to full load, and vice versa. For example, a typical split hull dump scow has an air draft (distance from the scow walkway surface to its waterline) ranging from roughly 20 feet when the scow is empty to roughly 4 feet when the scow is loaded. This large range of vertical movement in a working environment has made access to the dump scow via hinged ladders and/or pigeonholes difficult and dangerous.

Weather conditions, the state of the sea, and/or the type of material in the dump scow can further make passage from the barge to dump scow via the hinged ladder or pigeonholes difficult and dangerous. For example, windy weather conditions or rocky seas can cause the ladder to shift and become unstable during passage and potentially result in injury to crew members. Inclement weather could cause loss of balance while going up or down the pigeonholes resulting in injury and/or falling off the vessel.

One possible solution to these identified issues is use of a gangway typically used to allow passage to and from docks to vessels or aircrafts. However, traditional gangways are too complicated for a dredge environment, require too much deck space, and cannot accommodate the range of conditions experienced by a dredge and associated dump scow.

There is a continued need for a boarding system that can provide safe and continual access to scows at various air drafts, during most weather conditions, and in various sea states when alongside a dredge. Furthermore, there is a continued need for a boarding system with a compact design that reduces manual handling of a hinged ladder. Desirably, the boarding system does not use a traditional hinged ladder or pigeonholes.

SUMMARY

In concordance with the present disclosure, a boarding system that can provide safe and continual passage between vessels, which can be used at various air drafts, which can be used in most weather conditions, which can be used in various sea states, which is compact, and which eliminates the manual handling of a ladder, is surprisingly discovered.

In certain embodiments, a boarding system for passage from one vessel to an adjacent vessel comprises a platform, a plurality of support columns secured to the platform, a stairway attached to the platform, and a gangway pivotally connected to the platform and configured to pivot between a storage position and a deployed position. When the gangway is in the storage position, the gangway is in an upward position and when the gangway is in the deployed position, a distal portion of the gangway engages with the adjacent vessel at an angle corresponding to a condition of the adjacent vessel. The boarding system can further include a winch tower attached to one of the plurality of support columns, where the winch tower extends beyond a top surface of the platform.

In certain embodiments, a vessel can include a boarding system for passage from the vessel to an adjacent vessel, where the boarding system comprises a tower secured to the vessel, a platform and a plurality of support columns secured to the platform, two upper towers, each upper tower attached to a corresponding support column among the plurality of support columns, a stairway attached to the tower including a right and a left side ladder column, a gangway pivotally connected to the platform of the tower, the gangway including opposing siderails and a walking surface extending between the opposing siderails, and a winch system attached to the two upper towers, the winch system including a control mechanism configured to move the gangway between a storage position and deployed position.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Figure 1:
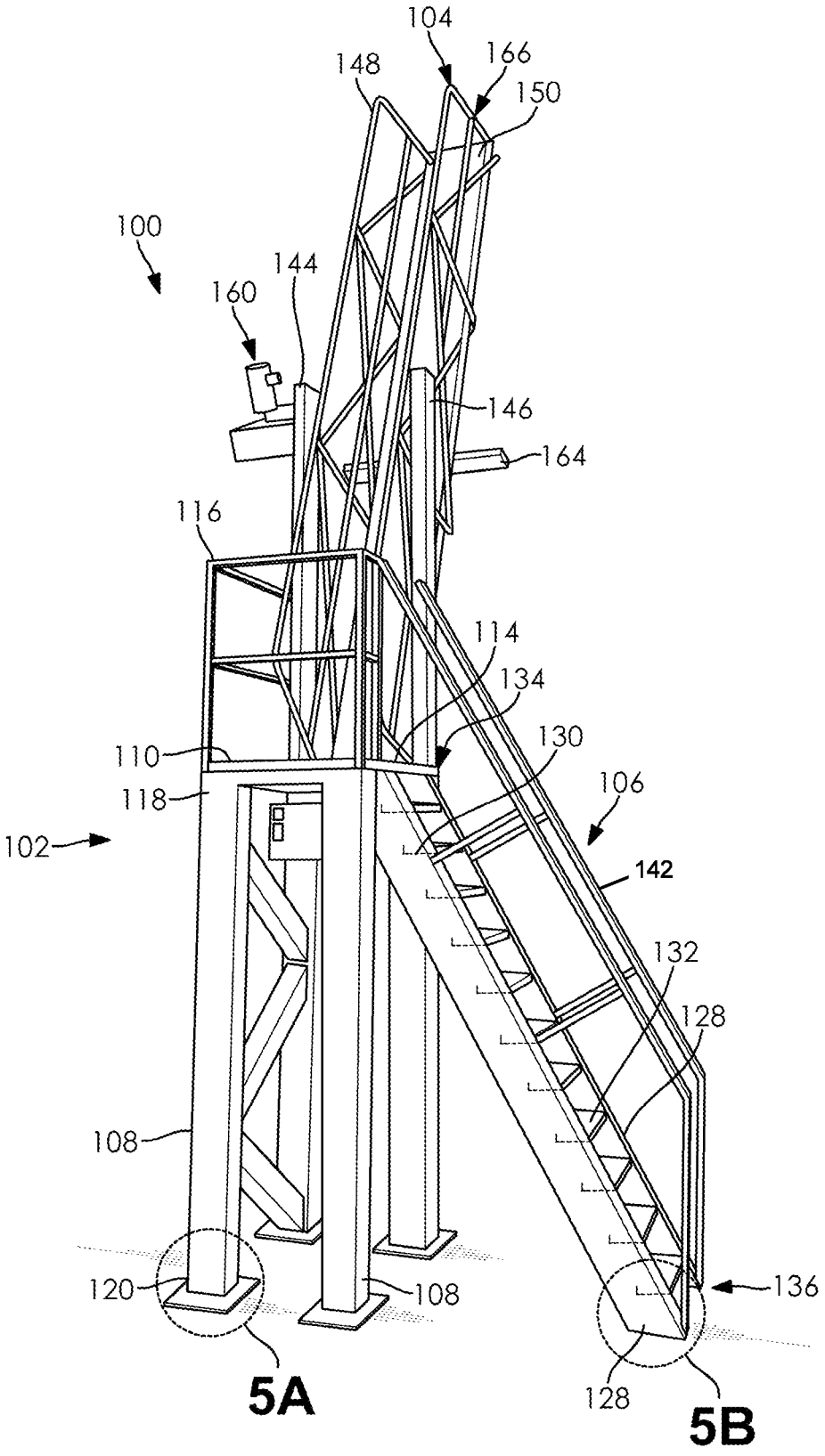
FIG. 1 is a front perspective view of a boarding system for passage from one vessel to an adjacent vessel, according to one embodiment of the present disclosure.
Figure 3A:
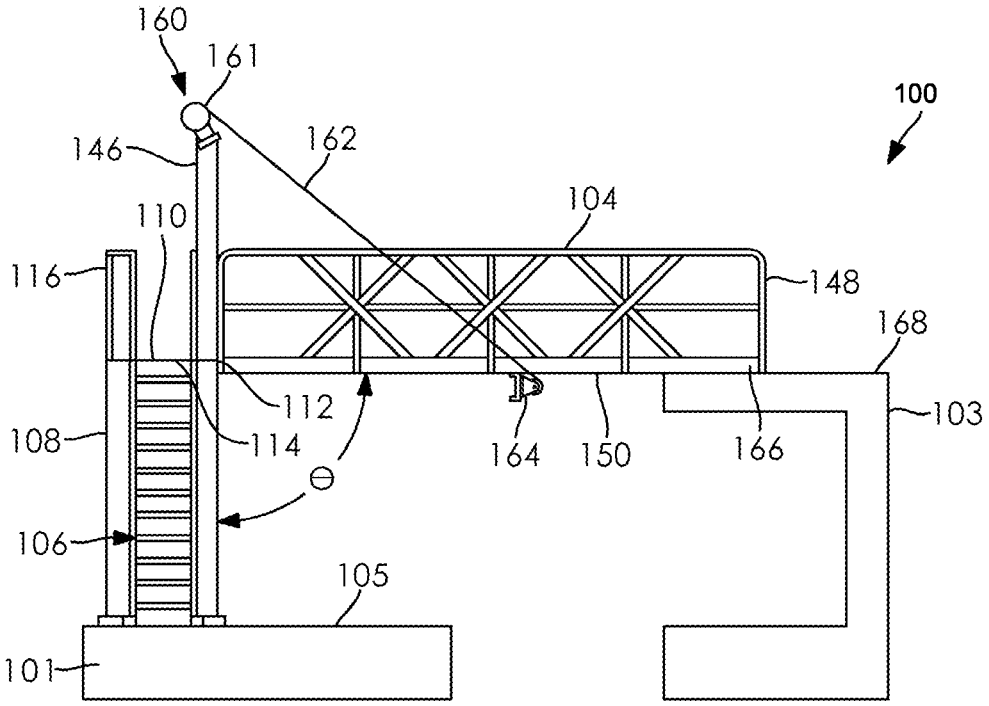
FIG. 3A is a front elevational view of the boarding system, further depicting a gangway in a first deployed position.
Figure 3B:
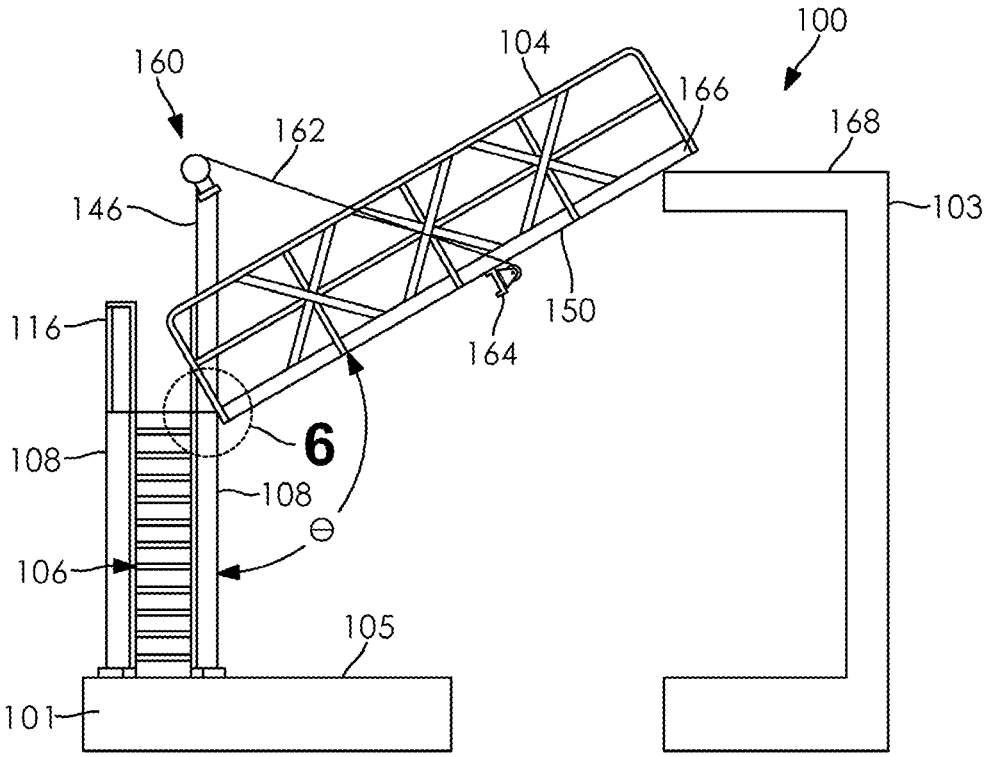
FIG. 3B is a front elevational view of the boarding system, further depicting the gangway in a second deployed position.
Figure 5A:
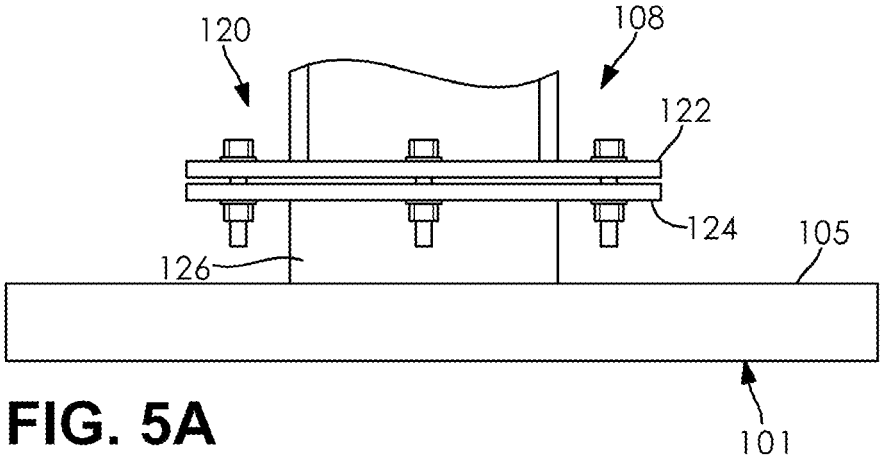
FIG. 5A is an enlarged, front elevational view of a platform support column of the boarding system taken at callout 5 in FIG. 1, further depicting a connection point of the platform support column and a deck of a barge.
Figure 5B:
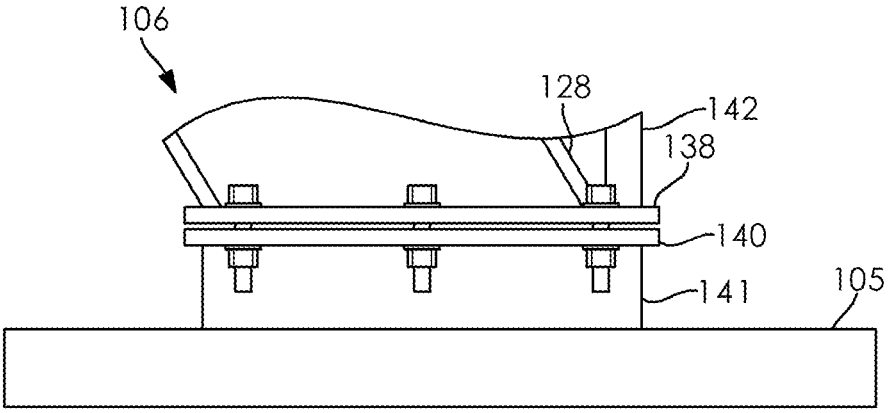
Figure 6:
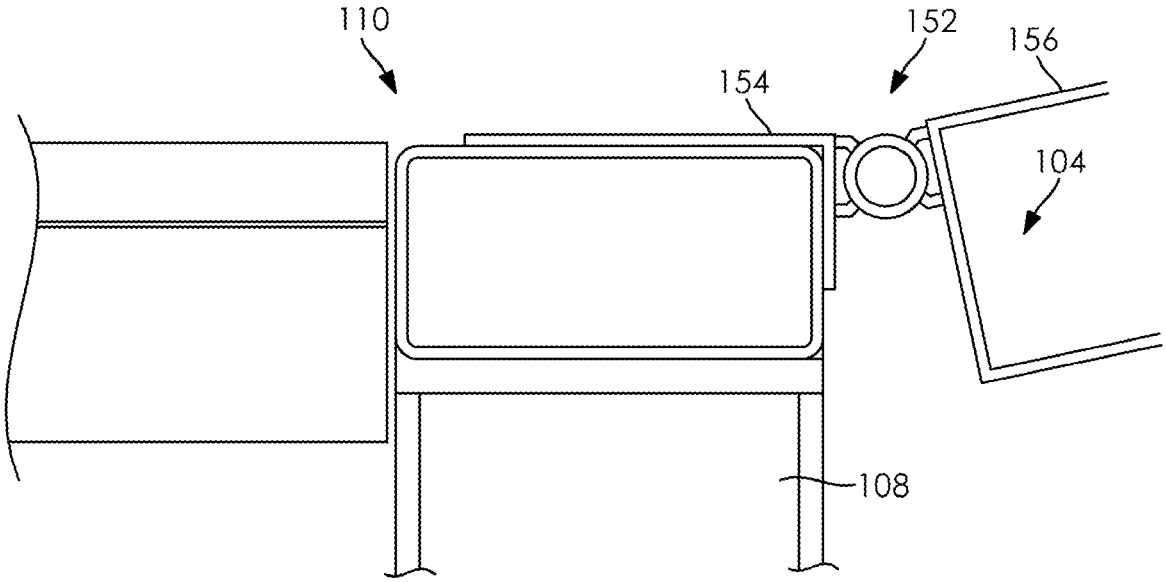

FIG. 5B is an enlarged, front elevational view of a ladder column of the boarding system taken at callout 6 in FIG. 1, further depicting a connection point of the ladder column and a deck of a barge; and FIG. 6 is an enlarged, front elevational view of a hinge system of the boarding system taken at callout 7 in FIG. 3B, further depicting a connection point of the gangway and a platform of the boarding system.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of an article of manufacture or process reciting elements A, B and C specifically envisions embodiments consisting of, and consisting essentially of, A, B and C, excluding an element D that may be recited in the art, even though element D is not explicitly described as being excluded herein.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8,1-3,1-2,2-10,2-8,2-3,3-10,3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a boarding system 100 for a vessel is shown. The boarding system 100 can be disposed on a barge or dredge 101. The boarding system 100 can allow for safe passage by a user between the barge 101 and an adjacent vessel 103. In certain examples, the barge 101 can include dredging barges and the adjacent vessel 103 can include a dump scow, as non-limiting examples. It should be appreciated that the boarding system 100 can be utilized with any suitable vessels within the scope of the present disclosure. The boarding system 100 of the present disclosure is particularly well suited for use in boarding vessels at multiple positions. For example, as described in greater detail herein, the boarding system 100 can allow the user to board a dump scow at an empty position where the dump scow can be disposed above the deck 105 of the barge 101 and a full position where the dump scow can be disposed below the deck 105 of the barge 101. Advantageously, the boarding system 100 can be utilized and adjusted to multiple positions, which can improve the overall safety of the user when boarding an adjacent vessel.

The boarding system 100 can include a tower 102. The tower 102 can be disposed on a deck 105 of the barge 101. A gangway 104 can be connected to the tower 102. In particular, the gangway 104 can be pivotably connected to the tower 102. The gangway 104 can allow the user to move from the tower 102 of the barge 101 to the adjacent vessel 103 safely. The tower 102 can further include a stairway 106, which can allow the user to climb the tower 102 to gain access to the gangway 104.

As shown in FIG. 1, the tower can include platform support columns 108 and a platform 110. In certain embodiments, the platform 110 can include a front side 112, a right side 114, a left side, and a back side. The stairway 106 can be disposed on the tower 102 at the front side 112 of the platform 110. The gangway 104 can be attached to the tower 102 at the right side 114 of the platform. The left side and back side of the platform can each include a handrail 116 to provide safety and support to a worker. Although the boarding system 100 is illustrated with the stairway 106 attached to the front side 112 of the platform 110 and the gangway 104 attached to the right side 114 of the platform 110, the gangway 104 and stairway 106 can be positioned on any side of the platform 110 while still remaining within the scope of the present disclosure.

The platform support columns 108 can be attached to the platform 110. In particular, each one of the platform support columns can have a top end 118 and a bottom end 120. The top end 118 of each one of the platform support columns 108 can be disposed on an underside of the platform 110, and more specifically, each one of the platform support columns 108 can be disposed proximate a corner of the platform. In one example, a support column among the plurality of support columns 108 can be attached at each one of a front right corner, a back right corner, a front left corner and a back left corner of the platform. In a non-limiting example, the plurality of platform support columns 108 can include structural square beams having a H-shaped cross-section, commonly referred to as H-Piles. In certain embodiments, each one of the top ends 118 of each one of the support columns 108 can be welded to the platform 110, however, other joining methods may be utilized while still remaining within the scope of the present disclosure.

The bottom end 120 of each one of the platform support columns 108 can attach to the deck 105 of the barge 101. It should be appreciated that the platform support columns 108 do not have to be in direct contact with the deck 105, but instead, each platform support column 108 can include a base plate 122 attached to the bottom end 120. The base plate 122 can be configured to engage with a corresponding plate 124 secured to the deck 105 of the barge 101. In one example, the support column 108 can be welded to the base plate 122. A spacer 126 can be disposed between the deck 105 of the barge 101 and corresponding plate 124 to provide a space between the deck 105 and plate 124. In one example, the spacer 126 can be a steel tube having one end welded to the deck 105 and an opposing end welded to the plate 124. When the base plate 122 is aligned with the corresponding plate 124, the spacer 126 between the plate 124 and deck 101 allow the two plates to be secured together using bolts, for example, as shown in FIG. 5A.

The stairway 106 of the boarding system 100 permits a worker access to the platform 110 of the tower 102. The stairway 106 can include a pair of ladder columns 128, including a right side ladder column and a left side ladder column. A plurality of angled plates or thread holders 130 can extend from the right side ladder column to the left side ladder column. The plurality of angled plates 130 can be welded to the right and left side ladder columns; however, other joining methods, such as riveting, bolting, or soldering, may be used while still remaining within the scope of the present disclosure. The plurality of angled plates 130 are configured to engage and secure steps 132 disposed along the length of the pair of ladder columns 128. The steps 132 can be spaced apart at a predetermined distance and can allow the worker to climb up or down the stairway 106 from the deck 101 to the platform 110 of the boarding system 100 and vice versa. In a non-limiting example, the steps 132 can include a walking surface manufactured with steel grating, such as F261131E48 fiberglass grating, commercially available from McNICHOLS® Metals Service Center (Tampa, FL), however, other suitable types of grating are contemplated and may be selected by one skilled in the art within the scope of the present disclosure.

Each one of the pair of ladder columns 128 can have a top end 134 and bottom end 136. The top end 134 of each of the pair of ladder columns 128 can be attached to the platform 110 and the bottom end 136 of each of the pair of ladder columns 128 can be secured to the deck 105 of the barge 101. A base plate 138 can be attached to the bottom end 136 of each of the pair of ladder columns 128. The base plate 138 can form a flange extending away from the steps 132. The base plate 138 can be attached to a corresponding plate 140. The corresponding plate 140 can include a spacer 141. The spacer 141 can be attached to the deck 105 of the dredge 101. In one example, one end of the spacer 141 can be welded to the deck 105 of the barge 101 and an opposite end can be welded to the plate 140. When the base plate 138 aligns with the corresponding plate 140, the space between the plate 140 and deck 105 can allow the two plates 138, 140 to be secured together with bolts, for example, as shown in FIG. 5B. By securing the boarding system 100 to the deck via the plate connections, the boarding system 100 can be easily removed when needed.

The stairway 106 can further include a pair of handrails 142. Each one of the pair of handrails 142 can have a bottom end and a top end. The bottom end of each of the handrails 142 can be secured to a front end of the corresponding flange or base plate 138 of each of the ladder columns 128. The top end of one of the handrails 142 can be secured to an upper tower such as a winch tower 144, which is described in greater detail below. The top end of the other handrail 142 can be secured to the handrail 116 of the left side of the platform 110. Each one of the handrails 142 can be positioned at a height, for example, that is between waist height and chest height of an average worker, such as for example, between approximately 3 feet to 5 feet above the top of the right and left side ladder columns 128. It should be appreciated that the handrails 116, 142 can together form a perimeter around open sides of the platform and stair columns 128, which can militate against the worker falling, in operation. A skilled artisan can select other suitable heights for the handrails 142, as desired.

With renewed reference to FIG. 1, the boarding system 100 can further include a first winch tower 144 and a second winch tower 146. The first winch tower 144 can be secured to the support column 108 attached to the front right corner of the platform 110. The second winch tower 146 can be secured to the support column 108 attached to the back right corner of the platform 110.

The gangway 104 can include opposing siderails 148 or handrails and a walking surface 150. The walking surface 150 can extend between the opposing siderails 148. The walking surface 150 can be a steel grating or a fiberglass grating, such as F261131E48 fiberglass grating, commercially available from McNICHOLS® Metals Service Center (Tampa, FL), however, other suitable types of grating are contemplated and may be selected by one skilled in the art within the scope of the present disclosure.

The gangway 104 can be pivotally connected to the right side 114 of the platform 110. The gangway 104 can be pivotally connected to the tower 102 using a hinge system 152, for example as shown in FIG. 6. The hinge system 152 can include a platform side hinge 154 attached to the right side of the platform 110 and a gangway side hinge 156 attached to the gangway 104. The platform side hinge 154 and the gangway side hinge 156 can be secured together with a retainer pin 158.

Referring back to FIGS. 1, 3A-3D, and 4, the boarding system 100 can include a winch system 160. The winch system 160 can be configured to lower and raise the gangway 104, in operation. The winch system 160 can be secured to the winch towers 144, 146. The winch system 160 can include a winch cable 162, which can be attached to an underside of the gangway 104 via a crossbar 164. The winch system 160 can include a plurality of pulleys 161, which allow for movement of the winch cable 162, in operation. The winch system 160 can be hardwired into a power supply (not shown) of the barge 101 via a control mechanism (not shown) located under the platform 110. The control mechanism can be configured to operate and control the position of the gangway 104 via the winch system 160. In particular, a length of the winch cable 162 can be adjusted via a motor of the winch system 160, which in turn, can adjust a pivot angle (θ) of the gangway 104.

Figure 3C:
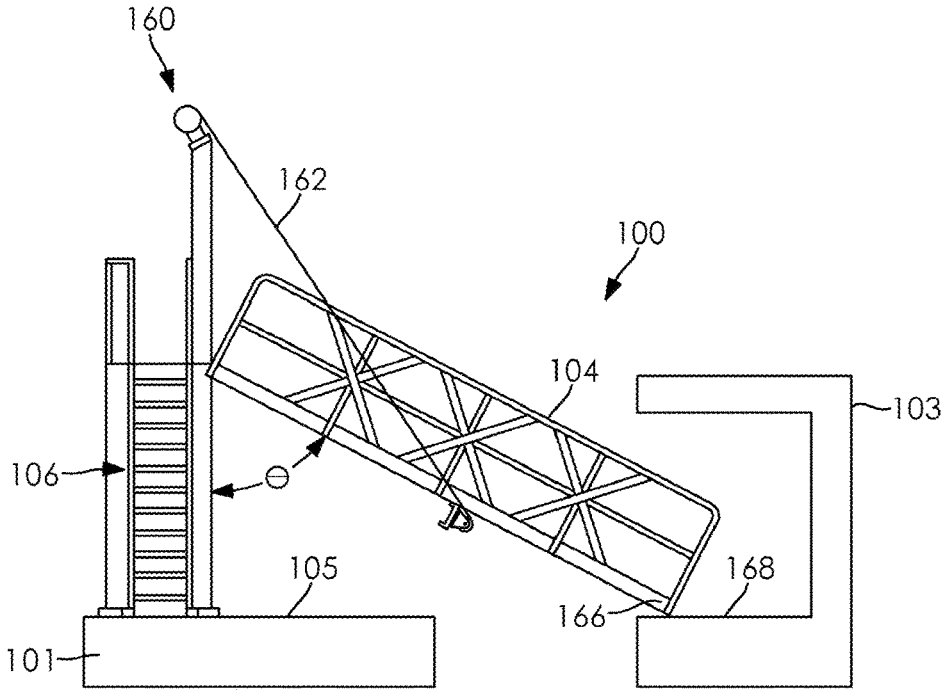
FIG. 3C is a front elevational view of the boarding system, further depicting the gangway in a third deployed position.
Figure 3D:
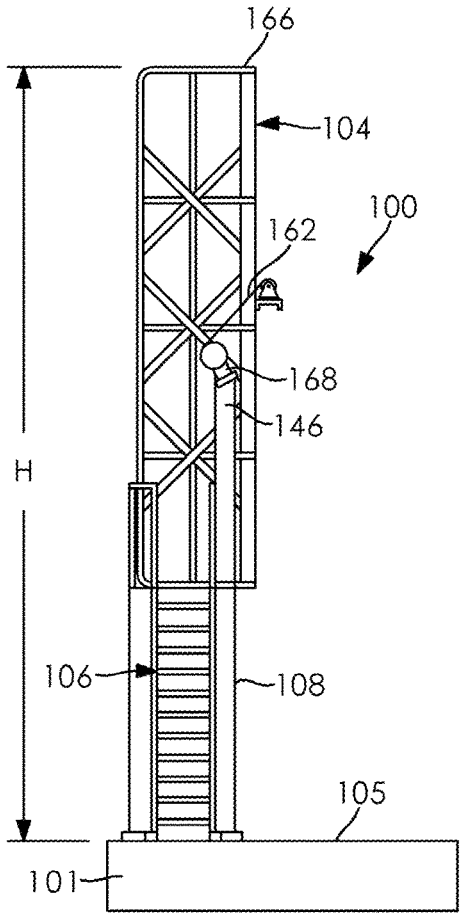
FIG. 3D is a front elevational view of the boarding system, further depicting the gangway in a stored position.
Figure 4:
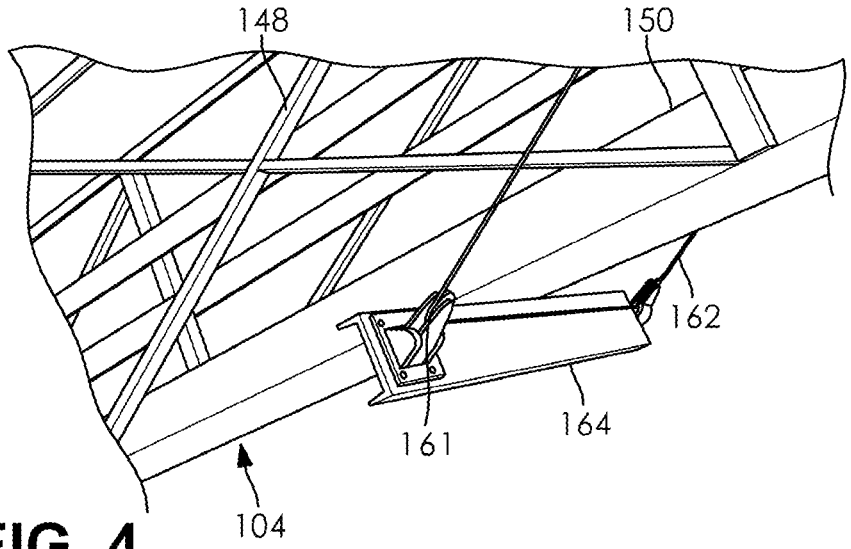
FIG. 4 is a front perspective view of a crossbar of the boarding system, further depicting a winch cable.

In operation, an operator can maneuver the gangway 104 between a deployed position, for example, as shown in FIGS. 3A, 3B, and 3C, and a stored position, for example, as shown in FIG. 3D. In the stored position, the gangway 104 can be in an upward position. In one example, when the gangway 104 is in the stored position, a height of the boarding system 100 from a tip of the gangway 104 to the deck 105 of the barge 101 can be approximately 26 feet. However, the height of the boarding system 100 can vary depending on a length of the gangway 104 and a height of the tower 102. In one example, the length of the gangway 104 is 18 feet and in another example, the length of the gangway 104 is 15 feet. However, it should be appreciated that one skilled in the art may employ different dimensions as desired.

In the deployed position, a distal, free end 166 of the gangway 104 can engage a nearby platform 168, such as a walkway surface of the adjacent vessel or scow 103. The gangway 104 can engage the platform 168 of the scow 103 at different angles depending on the condition of the scow 103. For example, during light scow conditions, where the scow is empty and its air draft is at its peak, the gangway 104 can be at an angle approximately 30° relative to the horizontal, for example, as shown in FIG. 3B. During mid-scow condition, where the scow is approximately half empty, the gangway 104 can have a zero tilt angle relative to the horizontal, for example, as shown in FIG. 3A. During heavy scow conditions, where the scow is full, the gangway 104 typically has a negative angle relative to the horizontal, for example, as shown in FIG. 3C.

Figure 2:
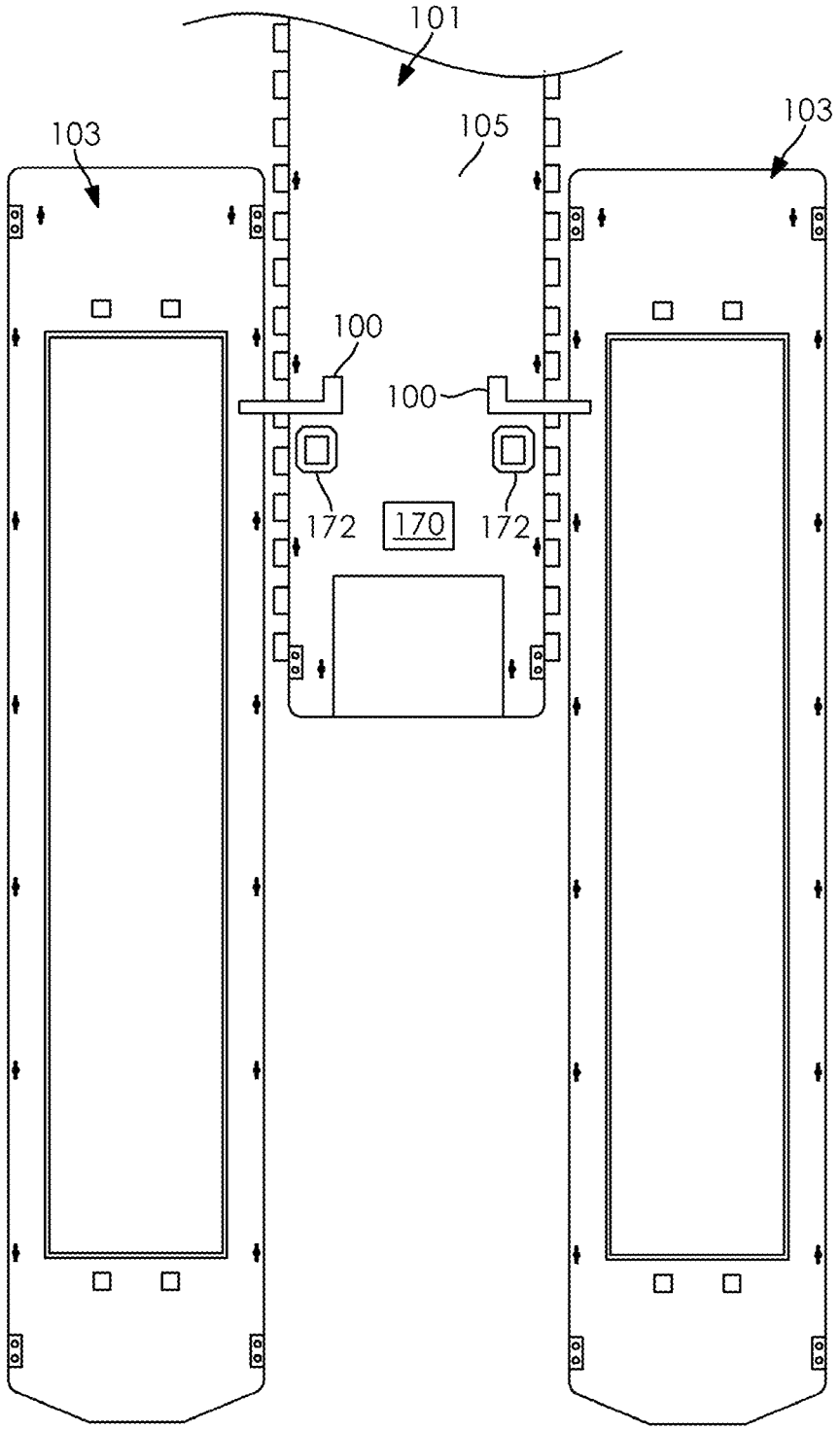
FIG. 2 is schematic, top plan view of the boarding system of FIG. 1, further depicting the use of the boarding system, in operation, allowing for passage from one vessel to an adjacent vessel.

With reference to FIG. 3D, as discussed earlier, when the gangway 104 is in the stored position, a height of the boarding system 100 from the tip of the gangway 104 to the deck 105 of the dredge 101 is approximately 26 feet. As such, placement of the boarding system 100 is important to reduce interfering with the swinging bucket of an excavator 170 on deck 105. It is desirable to position the boarding system near an existing tall structure, such as a spud 172, which is a tall shaft used to anchor or moor the barge to a particular area and protects the dredge 101 from movement due to currents, wind, and use of the machinery on the dredge 101. As best shown in FIG. 2, each boarding system 100 is attached to the deck 105 adjacent a spud 172, therefore no additional aerial hazards are introduced with normal dredging operations.

Advantageously, in mid-scow and heavy scow conditions, unlike hinged ladders traditionally used, the boarding system 100 provides a stable walking surface with siderails for safe and continual passage between the dredge 101 and scow 103. In addition, with the tower 102 sturdily secured to the deck 105 and stable engagement between the gangway 104 and platform 168, the boarding system 100 can be safely used in most weather conditions and various sea states while providing a safer work environment. Additionally, access to the platform 110 of the tower 102 is blocked by the gangway 104 when the gangway 104 is in the stored position. As shown, the gangway 104 can fold up into the platform 110 area as a space saver and safety feature.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A boarding system for passage from one vessel to an adjacent vessel, comprising:

a platform;

a plurality of support columns coupled to the platform;

a stairway coupled to the platform;

a first winch tower coupled to a support column among the plurality of support columns, wherein the first winch tower extends beyond a top surface of the platform;

a second winch tower attached to another support column among the plurality of support columns, wherein the second winch tower extends beyond a top surface of the platform;

a gangway pivotally connected to the platform and configured to move between a storage position and a deployed position, wherein the deployed position provides passage from the one vessel to the adjacent vessel; and a winch system configured to move the gangway between the storage position and the deployed position, the winch system including a winch cable attached to an underside of the gangway via a crossbar.

2. The boarding system of claim 1, wherein the gangway is in an upward position when the gangway is in the storage position, and a distal portion of the gangway engages with the adjacent vessel at an angle corresponding to a condition of the adjacent vessel when the gangway is in the deployed position.

3. The boarding system of claim 1, wherein the winch system is disposed on each of the first winch tower and the second winch tower.

4. The boarding system of claim 1, wherein the winch system includes a plurality of pulleys which receive the winch cable.

5. The boarding system of claim 4, wherein the winch system includes a motor configured to adjust a length of the winch cable to thereby change a pivot angle of the gangway.

6. The boarding system of claim 1, wherein the gangway includes opposing siderails and a walking surface.

7. The boarding system of claim 1, wherein a height of the boarding system from a tip of the gangway to a deck of the vessel is between about 15 feet and about 26 feet.

8. The boarding system of claim 1, wherein the gangway is coupled to the platform via a hinge system.

9. The boarding system of claim 8, wherein the hinge system includes a platform side hinge attached to a side of the platform and a gangway side hinge attached to the gangway.

10. The boarding system of claim 9, wherein the platform side hinge and the gangway side hinge are secured together with a retainer pin.

11. A system for passage from one vessel to an adjacent vessel, comprising:

a vessel including a deck; and a boarding system coupled to the vessel, the boarding system including:

a platform;

a plurality of platform support columns coupled to the platform, each of the platform support columns removably secured to the deck of the vessel, each platform support column includes a base plate attached to a bottom end of the platform support column, the base plate engaged with a corresponding plate secured to the deck of the vessel, and a spacer is disposed between the deck of the vessel and the corresponding plate, which provides a space between the deck and the corresponding plate;

a stairway coupled to the platform; and a gangway pivotally connected to the platform and configured to move between a storage position and a deployed position, wherein the deployed position provides passage from the one vessel to the adjacent vessel.

12. The system of claim 11, wherein the stairway includes a pair of ladder columns removably secured to a deck of the vessel.

13. The system of claim 12, wherein each ladder column includes a base plate attached to a bottom end of the ladder column, the base plate engaged with a corresponding plate secured to the deck of the vessel.

* * * * *